United States Patent [19]

Cryar et al.

[11] Patent Number: 4,993,397

[45] Date of Patent: Feb. 19, 1991

[54] APPARATUS FOR CALIBRATING ARCHERY BOWS

[76] Inventors: Alfred Cryar, 5116 Jefferson Cir., Guntersville, Ala. 35976; Bobby G. Cryar, 1002 Par Circle Dr., Hope, Ark. 71801; Charles G. Cryar, 18 Hanes Dr., Moody, Ala. 35004

[21] Appl. No.: 398,913

[22] Filed: Aug. 28, 1989

[51] Int. Cl.[5] ..... F41B 5/00

[52] U.S. Cl. ..... 124/23.1; 124/35.2; 124/88

[58] Field of Search ..... 124/23 R, 24 R, 88, 124/86, 89, 1, DIG. 1, 23.1, 24.1, 35.2, 25.6; 73/167; 33/265, 285, 506

[56] References Cited

U.S. PATENT DOCUMENTS

| | | | |
|---|---|---|---|
| 1,564,089 | 12/1925 | Maxwell | 124/24 R |
| 2,526,369 | 10/1950 | Kieselhorst | 124/23 R |
| 2,731,829 | 1/1956 | Wigington et al. | 73/167 |
| 3,343,411 | 9/1967 | Lee | 73/167 |
| 3,415,241 | 12/1968 | Bear | 124/24 R |
| 4,466,418 | 8/1984 | Jones | 124/23 R X |
| 4,621,563 | 11/1986 | Poiencot | 73/167 X |

*Primary Examiner*—Peter M. Cuomo

*Attorney, Agent, or Firm*—Phillips & Beumer

[57] ABSTRACT

An apparatus for calibrating an archery bow is described. The apparatus provides for securing a bow at its hand grip portion to a horizontal shaft, the bow being disposed generally perpendicular to the shaft. The shaft is mounted for rotation on a frame, which also supports a trigger spaced apart from the shaft a sufficient distance to engage the bowstring of the bow in fully drawn position. This arrangement allows the bow, when an arrow is fired, to return to its initial alignment. The shaft is mounted on a fixture that may be slid by engagement of bolts in slots of each side of the frame to adjust the shaft ends in the radial direction, and adjustable bolts coaxial with the shaft provide for adjustment in the actual direction. The trigger is secured to a plate that is slidably mounted on the end of the frame opposite the shaft. Adjustments in location of the trigger to accommodate different bowstrings are provided by bolts that ride in slots in support members on which the trigger-holding plate is mounted. This apparatus minimizes human error in reproducibly aligning bows for firing arrows to produce a test pattern from which the nocking point and other features may be adjusted to the correct position.

11 Claims, 3 Drawing Sheets

APPARATUS FOR CALIBRATING ARCHERY BOWS

FIELD OF THE INVENTION

This invention relates generally to archery equipment and more particularly to apparatus for calibrating archery equipment and enabling proper adjustments to be made.

BACKGROUND OF THE INVENTION

The accuracy of a bow depends strongly on its being properly calibrated and adjusted. In particular, the "nocking point," or point on the bow where the arrow is placed, must be established at an optimum location and marked so that each arrow will be shot from that location. Other adjustments that may be required, depending on the type of bow, include adjustments to cams on compound bows and to the arrow rest on bows. In general, such adjustments are made by shooting several arrows at a target under the same condition and determining the extent to which the resulting pattern is off the desired target location. The knocking point or other adjustable feature is then changed to bring the pattern to the correct location. For effective calibration, this procedure requires that each arrow of a group be fired under precisely reproducible conditions, which result is difficult to obtain by manual shooting owing to the effects of human error or variations in the individual archer's stance.

Various devices relating to mounting and calibration of archery bows are disclosed in prior patents. U.S. Pat. No. 3,651,578 discloses a bow square instrument for calibrating a bow using graduated scales but is not concerned with mounting a bow for shooting a test pattern of errors. U.S. Pat. No. 1,804,450 shows an error testing device wherein a bow is securely mounted to a mechanism that allows for some pivotal movement by adjustment of a turn buckle. The bow in this device is not allowed to rotate freely after an arrow is shot. An archery stand on which a bow is rotatably supported on a horizontal axis is disclosed in U.S. Pat. No. 1,564,089, but this device is concerned only with archery practice and with tuning of bows. A gunsight alignment device providing for rotatable mounting of a weapon on a horizontally disposed pivot pin is disclosed in U.S. Pat. No. 4,621,563. This device allows for limited pivotal movement of the weapon around the pin upon being fired, but such movement is stopped when the weapon contacts a recoil-absorbing spring. None of these patents show a bow calibrating device wherein the bow is rotatably mounted on a horizontal shaft to enable it to be reproducibly brought back to the same position in shooting a test pattern.

SUMMARY OF THE INVENTION

The present invention is directed to an apparatus for calibrating archery bows that has a horizontally mounted shaft and means for securing a bow to the shaft in vertical shooting position, the shaft being disposed to allow it and the bow secured thereto to be rotated freely upon firing an arrow so that the bow may be readily brought back to the same position for firing of a series of arrows. A trigger for releasably securing the bowstring in fully drawn position is disposed generally in the same horizontal plane as the shaft. Adjustment features may be provided for precise positioning of the shaft ends and for varying the distance between the trigger and shaft to accommodate bowstrings of differing lengths or pull characteristics. A suitable frame member supports the shaft ends and trigger in proper alignment. This apparatus minimizes the possibility of human error in shooting a test pattern of arrows by enabling the bow to rotate freely in a vertical plane upon shooting an arrow and returned precisely to the same position upon drawing the bow for shooting the next arrow. The resulting test pattern enables highly accurate calibration adjustment of the knocking point as well as any adjustments necessary to arrow rests or cams of compounds bows.

It is, therefore, an object of this invention to provide an apparatus for calibrating archery bows that enables shooting of a group of arrows under precisely reproducible conditions.

Another object is to provide such an apparatus that allows a bow after shooting an arrow to be returned repeatedly to the same position.

Another object is to provide a bow-calibrating apparatus which minimizes human error in shooting a test pattern.

Other objects and advantages of the invention will be apparent from the following detailed description.

DESCRIPTION OF THE PREFERRED EMBODIMENT

Figure 1:
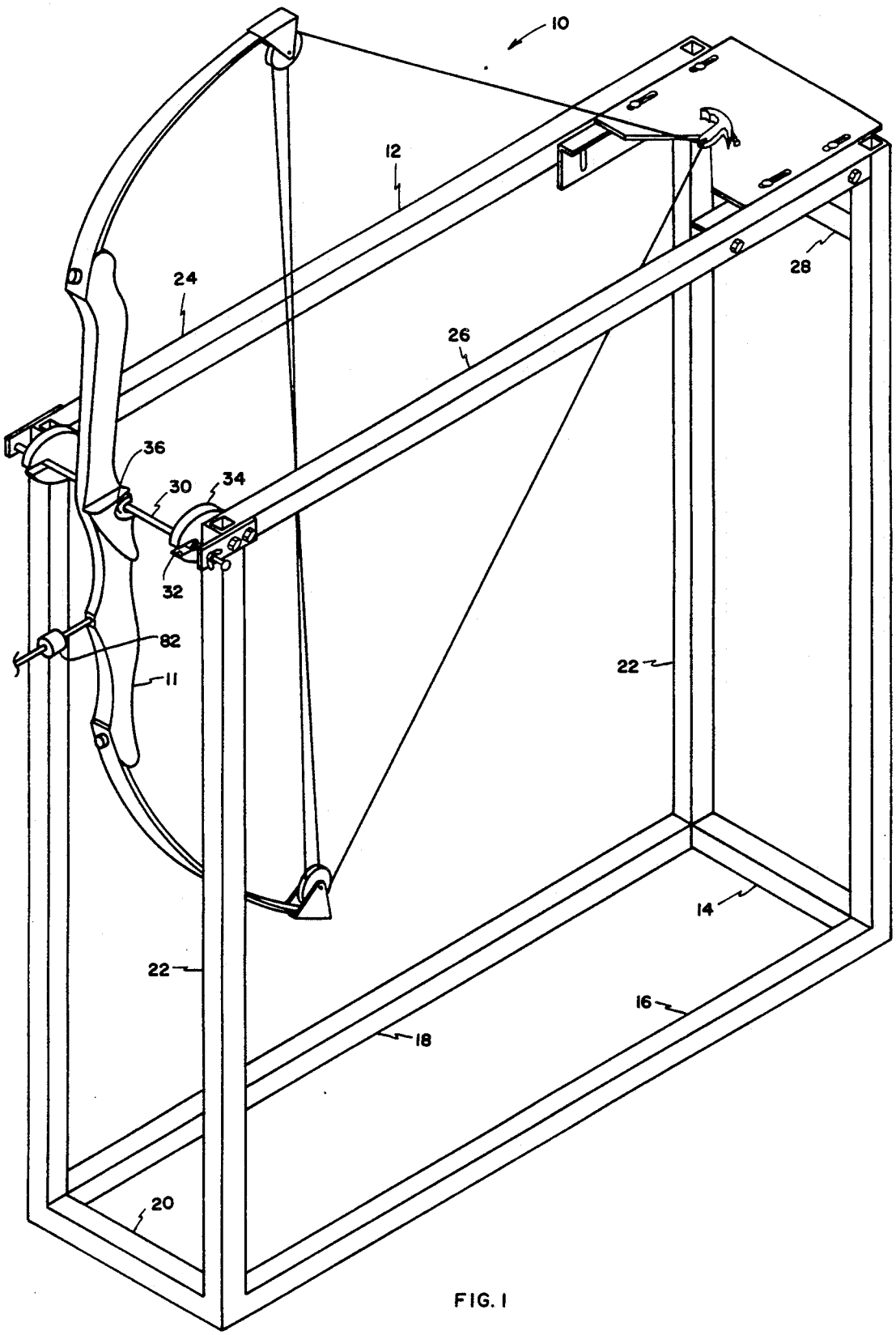
FIG. 1 is a pictorial view of an apparatus embodying the invention.

Referring to FIG. 1 of the drawings, an apparatus 10 for use in calibrating an archery bow is shown. The apparatus has an upright rectangular metal frame 12 made up of metal members in the form of square tubing with members 14, 16, 18, and 20 at the bottom forming a rectangular base and legs 22 extending upward from its corners. Upper side members 24 and 26 are joined to upper ends of the legs, and a cross member 28 secures the legs near their upper ends at the rear of the frame. In operation of the device, the frame may be placed on a flat horizontal surface so that member 24 and 26 are disposed spaced apart from one another in a horizontal plane.

Figure 2:
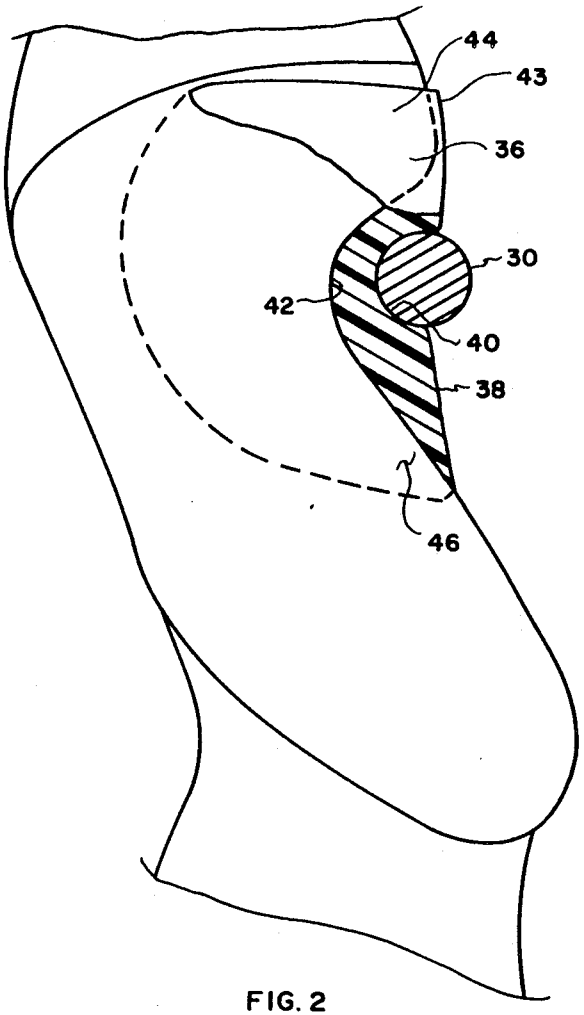
FIG. 2 is an enlarged view, partly in section, showing a bow mounted on a shaft in the apparatus.

Shaft 30 is disposed near the upper front end of the frame and is supported for rotation within horizontally extending notches 32 of disc-shaped support fixtures 34 that are located inside the ends of the legs 22. As shown in FIG. 2, shaft 30 at its center has removably secured thereto a saddle or bow support member 36 that has a block 38 of molded plastic with a transverse groove 40 of semi-circular cross section adapted to fit over the shaft. The block is shaped so that its side opposite the groove conforms to the inwardly curved portion 42 of the bow hand grip. This position may vary for different types of bows, but a block conforming to the shape of a particular bow may be readily formed by hand molding of a plastic such as epoxy resin against the surface of this portion of the bow. The block has integral therewith a U-shaped envelope 43 with wings 44 and 46 that extend over the surface of the bow and assist in guiding the bow into the desired position. Saddle 36 may be secured to shaft 30 and the bow by means of a strong rubber strap such as a piece of inner tube wrapped tightly around these parts when in aligned relation. The bow when secured to the shaft should be aligned generally perpendicular to the shaft in a vertical plane halfway between frame members 24 and 26.

Figure 3:
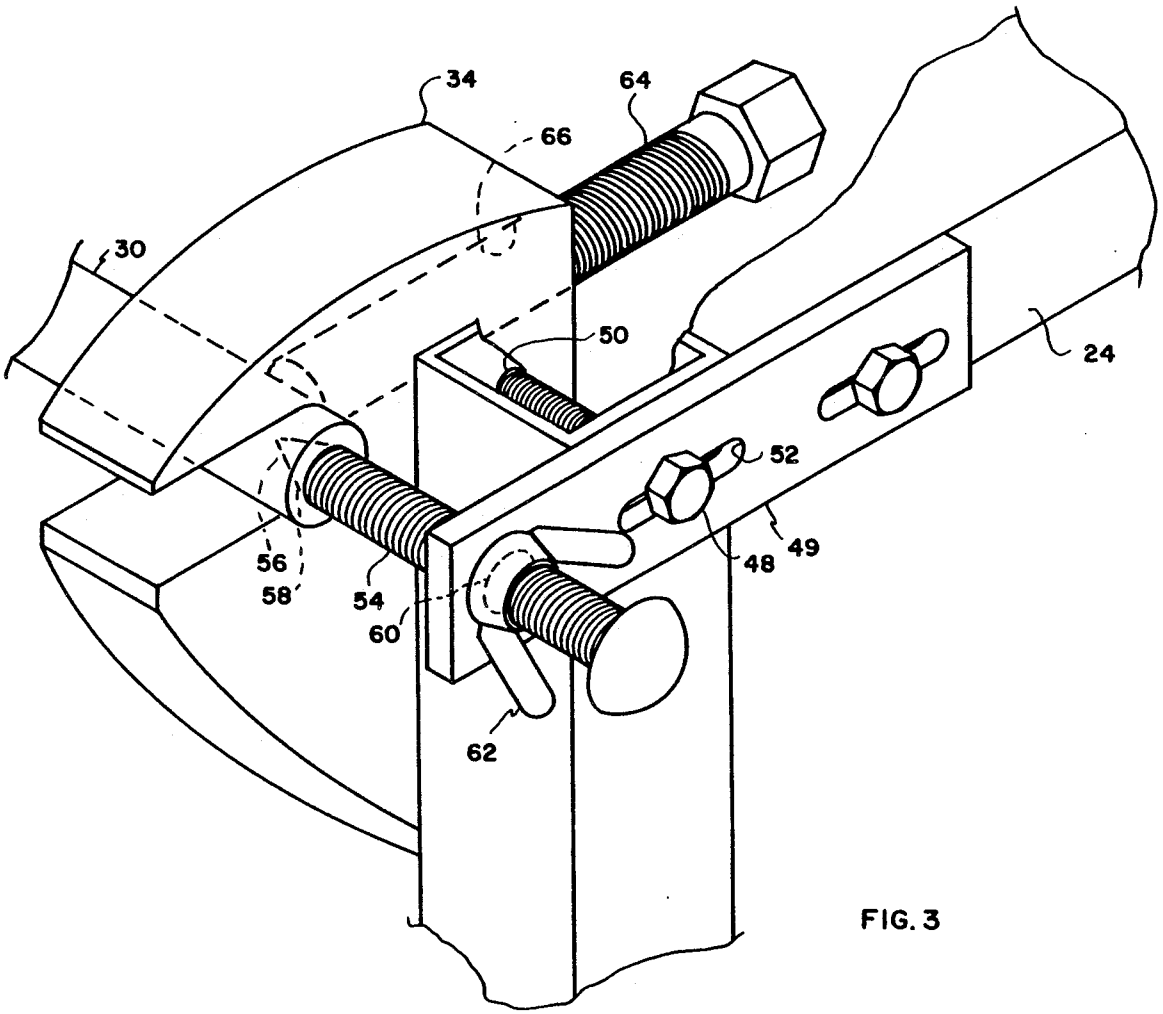
FIG. 3 is an enlarged pictorial view showing shaft support and adjustment features.

Details of components for supporting and aligning the shaft at its end are shown in FIG. 3. Fixture 34 with its notch 32 extending horizontally to the front is connected to bar 49 that is an extension of frame member 24 by means of a bolt 48 that engages a threaded aperture 50 in a side face of the fixture. The bolt rides in a horizontally extending slot 52 in the frame member, which provides for adjustment of the position of the fixture by loosening the bolt, sliding it and the attached fixture to the desired location, and tightening the bolt at that location. Shaft 30 may be further adjusted in the axial direction by moving it to the desired position and securing it there by a bolt 54 having a conical end 56 that mates with a conical depression 58 in the shaft ends. The bolt extends through aperture 60 in bar 49 and is secured in adjusted position by wing nut 62 that engages threads on the bolt. Further fine adjustment of the shaft position in the radial direction may be provided by bolt 64 that is threaded into aperture 66 in the rear face of the block, the forward end of the bolt extending slightly into the bottom of notch 32. Tightening or loosening the bolt will move the shaft end forward or backward to a desired position.

Figure 4:
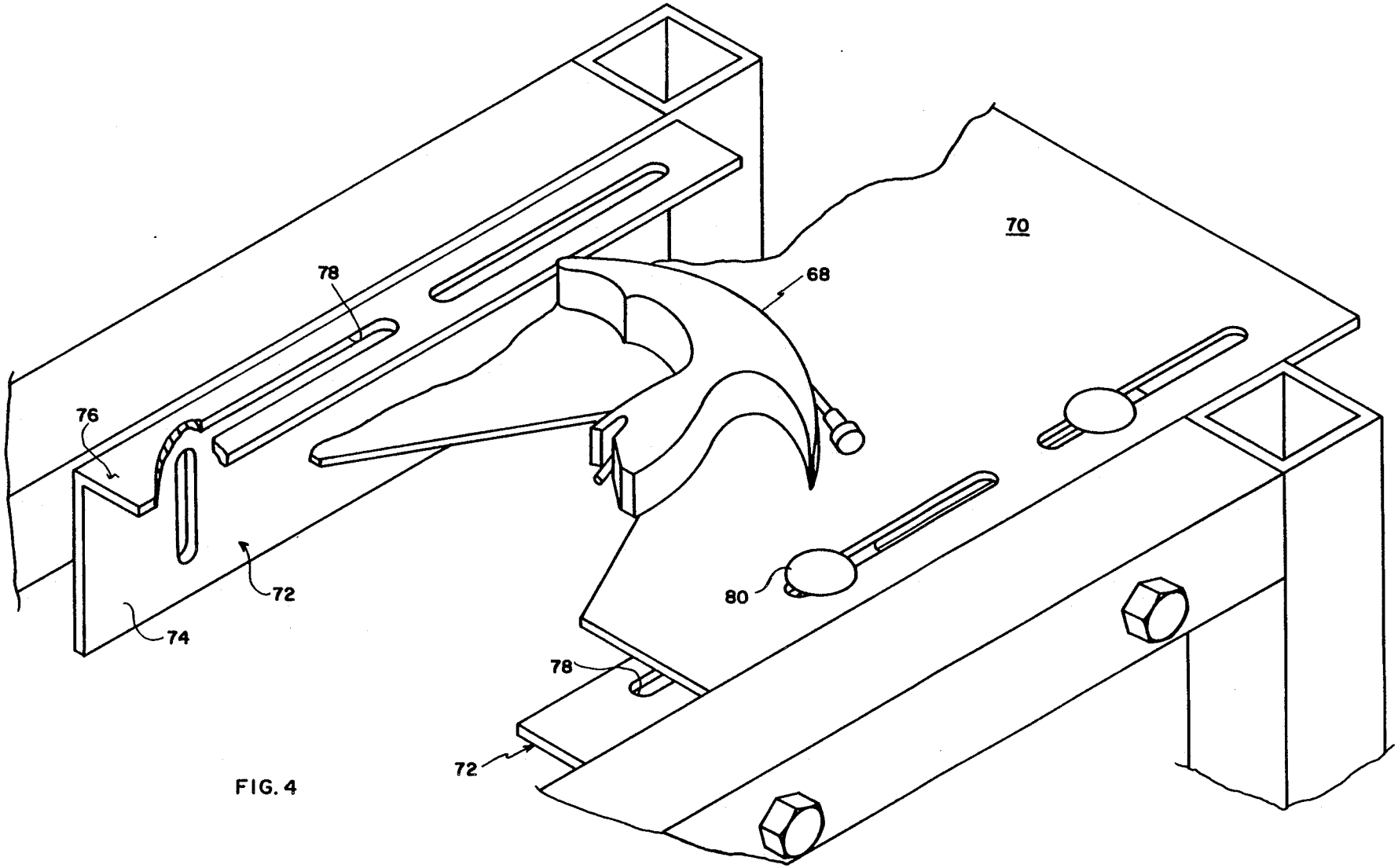
FIG. 4 is an enlarged pictorial view showing trigger support and adjustment features.

FIG. 4 shows trigger 68 mounted on plate 70, the plate in turn being slidably connected to angle iron supports 72 that have one side 74 connected to an inner face of members 26 and 28 and the other side 76 providing a horizontally extending surface. A longitudinally extending slot 78 in side 76 receives a bolt 80 that may be tightened to secure the trigger in a desired location corresponding to the fully drawn bowstring position for a particular bow.

In operation of the apparatus, a compound bow is attached to the shaft and positioned as shown in FIG. 1, and adjustments are made as necessary to precisely align the shaft as described above. In order to determine whether the nocking point of the bowstring is located correctly, a group of arrows, typically four to five, are shot at a target which may be a sheet of paper or the like located a distance such as 15 yards away from the bow and disposed in a vertical plane. After each arrow is fired, the bow and shaft secured thereto rotate downward due to force imparted by weight 82 below the center of gravity of the bow. Any recoil forces with reaward components generated upon release of the bow, which would move the bow out of position is manually held, are converted to rotary motion of the bow and shaft. The bow may then be brought to the same position upon drawing the bowstring and engaging with the trigger. After firing a group of arrows, the holes made in the target may be examined to determine whether the nocking point was correctly located. If the holes are in the position aimed at and are round, no adjustment would be needed. Holes that are out of position or oblong indicate that the nocking point needs to be moved up or down the bowstring. Accuracy of the adjustment may be determined by firing an additional group of arrows after moving the nocking point.

Adjustments to cams of compound bows and to arrow rests may be made in a similar manner by firing a group of arrows and making corrections as required so that the desired pattern is obtained.

While the apparatus in the embodiment disclosed is shown in use for calibration of a compound bow, it may also be used for other types of bows such as longbows and recurved bows. It is also to be understood that the invention is not limited to the embodiment described above but only as indicated by the appended claims.

We claim:

1. Apparatus for calibrating an archery bow comprising:

an upright frame having a pair of spaced-apart side members;

a shaft;

means connected to said side members for supporting said shaft thereon for rotation in a horizontal position;

means for securing a bow to said shaft in alignment wherein the length of the bow is generally perpendicular to the shaft, said frame defining sufficient open space to enable said bow secured in said alignment to be fully rotated around the axis of said shaft without obstruction; and means supported by said frame spaced apart from the shaft for releasably securing a bowstring in fully drawn position, whereby, upon releasing said bowstring and shooting an arrow, said bow is free to rotate around the axis of said shaft and to be returned to the alignment that existed before shooting the arrow.

2. Apparatus as defined in claim 1 wherein said bow has an indented hand grip portion, and said means for securing said bow to said shaft includes a block having on one side a groove matable with the shaft and on its other side a rounded surface conforming to the shape of said hand grip portion.

3. Apparatus as defined in claim 2 wherein said block has wing portions integral with and extending perpendicular to the shaft on the side opposite the groove providing a U-shaped configuration for securing the bow.

4. Apparatus as defined in claim 1 wherein said means for supporting said shaft comprises a pair of support fixtures connected to opposite sides of said frame, each such fixture having a notch for receiving said shaft and supporting the same. having a notch for receiving said shaft and supporting the same.

5. Apparatus as defined in claim 1 including means for adjustment of said shaft in directions axial and radial to the shaft.

6. Apparatus as defined in claim 5 wherein said means for adjusting said shaft in the radial direction comprises a pair of slidable bars secured to sides of said frame, each bar having a longitudinally extending slot, means securing ends of the shaft to said bars, and means secured to said fixture and movable in said slot to obtain placement and retention of said shaft ends in a desired position.

7. Apparatus as defined in claim 6 wherein said means for adjusting said shaft further comprise a threaded aperture in said fixture communicating with said notch from a side of the fixture opposite thereto and bolt means threadably engaging said aperture and adapted to be moved into said notch from said opposite side.

8. Apparatus as defined in claim 7 wherein said means for adjusting said shaft in the axial direction comprises a pair of bolts coaxial with said shaft, each extending through an aperture in said bar, ends of said shaft having depressions for receiving ends of said axially extending bolts, and means for removably securing said bolts in a fixed position with respect to said bars and with ends of the bolts engaging depressions in the ends of said shafts.

9. Apparatus as defined in claim 1 wherein said means for releasably securing said bowstring is adjustable toward and away from said shaft.

10. Apparatus as defined in claim 9 wherein said means for securing said bowstring comprises a plate slidably mounted on said frame and a trigger secured to said plate.

11. Apparatus as defined in claim 10 including a pair of horizontally disposed support members defining flat surfaces for receiving edge regions of said plate, longitudinally disposed slots penetrating said support members, and releasable fastening means extending through said slots and coupling said plate to said support members, said fastening means being movable in said slots, whereby said trigger may be moved toward and away from said shaft and secured in a desired position.

* * * * *